US011320198B2

(12) United States Patent
Kong

(10) Patent No.: US 11,320,198 B2
(45) Date of Patent: May 3, 2022

(54) METHOD FOR IMPROVED STARTUP OF AN AIR SEPARATION UNIT HAVING A FALLING FILM VAPORIZER

(71) Applicant: L'Air Liquide, Societe Anonyme pour l'Etude et l'Exploitation des Procedes Georges Claude, Paris (FR)

(72) Inventor: Paul Kong, Sugar Land, TX (US)

(73) Assignee: L'Air Liquide Société Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 154 days.

(21) Appl. No.: 16/911,945

(22) Filed: Jun. 25, 2020

(65) Prior Publication Data

US 2021/0404741 A1 Dec. 30, 2021

(51) Int. Cl.
*F25J 3/02* (2006.01)
*F25J 3/04* (2006.01)

(52) U.S. Cl.
CPC ..... *F25J 3/04412* (2013.01); *F25J 3/0409* (2013.01); *F25J 3/04393* (2013.01); *F25J 3/04406* (2013.01); *F25J 3/04478* (2013.01); *F25J 3/04818* (2013.01); *F25J 3/04848* (2013.01); *F25J 2280/10* (2013.01)

(58) Field of Classification Search
CPC .. F25J 3/04478; F25J 3/04406; F25J 3/04412; F25J 3/04812; F25J 3/04818; F25J 2280/10
See application file for complete search history.

(56) References Cited

U.S. PATENT DOCUMENTS

RE36,435 E * 12/1999 Grenier ..... F25J 3/04412 165/166
2002/0017112 A1* 2/2002 Lehman ..... F25J 3/04969 62/643
2004/0055331 A1* 3/2004 Corduan ..... F25J 3/04412 62/643
2006/0075778 A1* 4/2006 Lehman ..... F25J 3/0486 62/643

* cited by examiner

*Primary Examiner* — Brian M King
(74) *Attorney, Agent, or Firm* — Justin K. Murray

(57) ABSTRACT

A method for starting up an air separation plant having a higher-pressure column, a lower-pressure column, and a falling film vaporizer disposed within a lower section of the lower-pressure column is provided. The method can include the steps of: introducing a cooled and compressed air stream into the higher pressure column; withdrawing an oxygen-enriched liquid stream from a bottom section of the higher-pressure column and introducing said oxygen-enriched liquid stream to an upper section of the lower-pressure column; and exchanging heat between nitrogen gas coming from a top section of the higher-pressure column and liquid oxygen from the lower-pressure column within the falling film vaporizer. During a start-up period, flow of liquid oxygen is at least reduced to the closed core. This reduces the available heat exchange area during start up, which increases ΔT and ΔP in the condenser/reboiler.

7 Claims, 1 Drawing Sheet

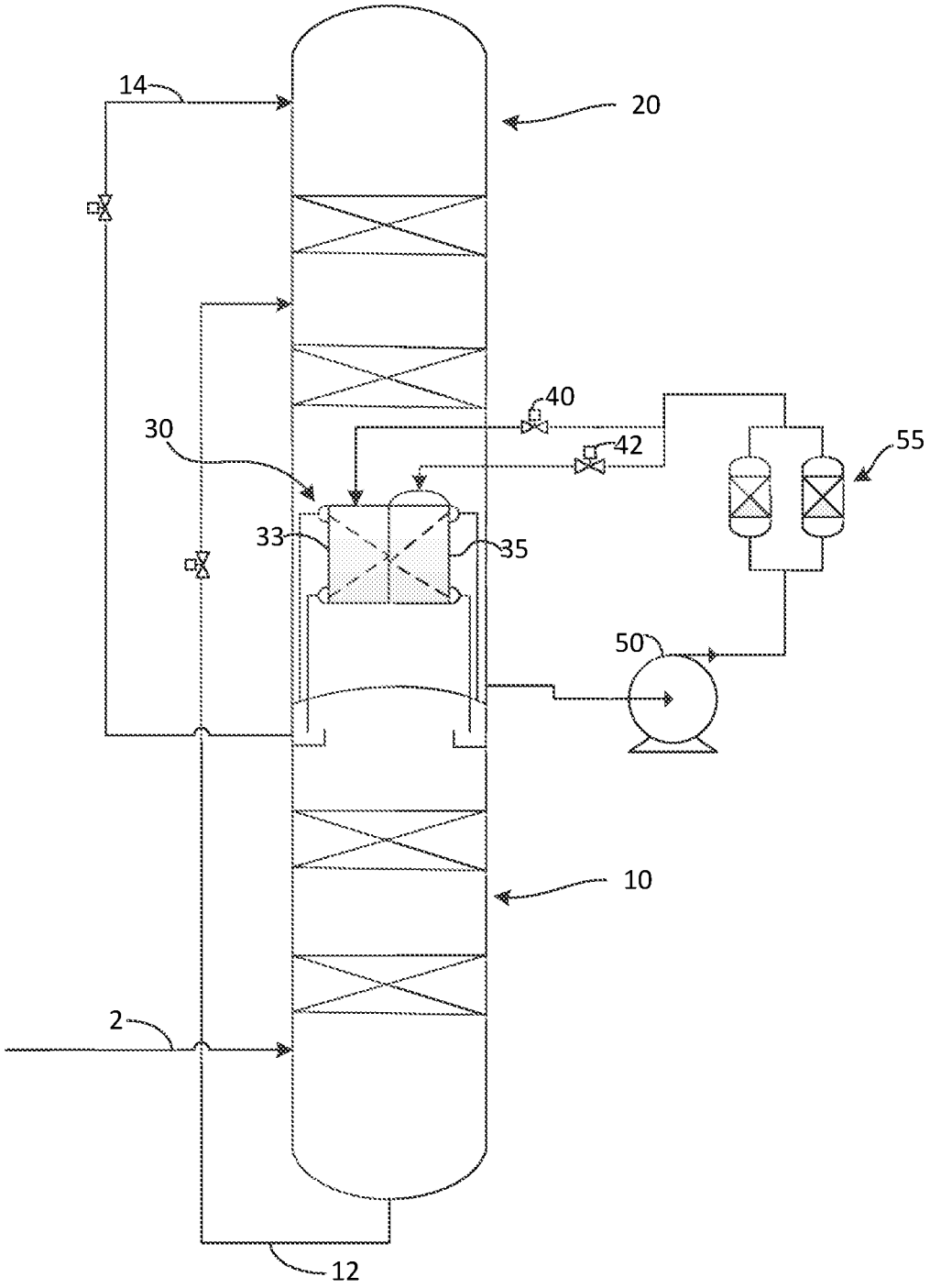
14
20
40
30
42
55
33
35
50
10
2
12

METHOD FOR IMPROVED STARTUP OF AN AIR SEPARATION UNIT HAVING A FALLING FILM VAPORIZER

TECHNICAL FIELD OF THE INVENTION

The present invention generally relates to a method and apparatus for efficiently starting up an air separation plant that uses a falling film (down flow) type vaporizer.

BACKGROUND OF THE INVENTION

Air separation plants separate atmospheric air into its primary constituents: nitrogen and oxygen, and occasionally argon, xenon and krypton. These gases are sometimes referred to as air gases.

A typical cryogenic air separation process can include the following steps: (1) filtering the air in order to remove large particulates that might damage the main air compressor; (2) compressing the pre-filtered air in the main air compressor and using interstage cooling to condense some of the water out of the compressed air; (3) passing the compressed air stream through a front-end-purification unit to remove residual water and carbon dioxide; (4) cooling the purified air in a heat exchanger by indirect heat exchange against process streams from the cryogenic distillation column; (5) expanding at least a portion of the cold air to provide refrigeration for the system; (6) introducing the cold air into the distillation column for rectification therein; (7) collecting nitrogen from the top of the column (typically as a gas) and collecting oxygen from the bottom of the column as a liquid.

Falling film (downflow) type heat exchangers are commonly used as the main condenser-reboiler for making a thermal link between two surmounted distillation columns (higher and lower pressure columns) in an air separation unit ("ASU") that provides boil-up in the lower pressure column and reflux in the higher pressure column. The falling film design has an advantage of having low exchange temperature differential, thereby resulting in a lower operating pressure in the higher pressure column, and consequently, a lower energy consumption than for a column system employing a bath-type condenser-reboiler.

One type of flow arrangement for a falling film condenser-reboiler is recirculation type; wherein the condenser-reboiler consists of an open core and a closed core; each having half of the exchange area and each vaporizing half of a feeding liquid. Falling liquid oxygen (LOX) from the sump of the lower pressure column is fed to the open core where half of the liquid is being vaporized. The remaining liquid combined with the liquid from the closed core is recirculated into the closed core by a recirculation pump.

However, an ASU with a falling film main condenser-reboiler often suffers a drawback of having difficulty of hydraulically transferring the liquids (refluxes) from the higher pressure column to the lower pressure column during plant startup. This is due to the fact that both flow and purity profiles are significantly deviated from the steady state. This is because the plant experiences a reduced air flow, which results in lower temperature differential in the condenser-reboiler, as well as lower $O_2$ content in the sump of the lower pressure column and higher $O_2$ content in the reflux, which results in a lower boiling temperature in the lower pressure column and a lower condensing temperature in the higher pressure column. This all combines to cause the higher pressure column to experience a lower than normal steady state operating pressure during startup.

When the pressure differential between the two columns is not sufficient to overcome the hydraulics created by the difference in elevation in a stacked column configuration, liquid sent from the bottom of the higher pressure column to the upper section of the lower pressure column will suddenly quit flowing, which interrupts the startup process and can lead to a plant trip. This often causes a significant delay in startup, and consequently, economic impact.

As such, there is a need for an improved start-up method and apparatus for ASUs that employ falling film vaporizers.

SUMMARY OF THE INVENTION

The present invention is directed to a method and apparatus that satisfies at least one of these needs.

In one embodiment, the invention can include an improved method of starting such process by temporarily stopping the sump liquid feed to the closed core (i.e., closing the LOX feed valve). It effectively takes the closed core exchanger out of service and reduces the overall heat exchange area, therefore, increasing $\Delta T$ and $\Delta P$ in the condenser/reboiler. Additionally, dry vaporization of the open core portion of the exchanger is greatly reduced or even eliminated by increasing LOX recirculation (i.e., opening LOX recirculation valve) to the open core.

Optional embodiments to improve the startup process can also include: (1) increasing the lower pressure column pressure higher than normal operating pressure by setting the pressure controller set point from 5.5 to 8 psig, and/or (2) setting the oxygen product flow lower than normal to speed up the recovery of oxygen purity. Since an increase of 1-psig in the low pressure column will increase the pressure of the high column by more than 1 psig, the resulting $\Delta P$ is increased.

In another embodiment, once certain operational set points are achieved (e.g., normal air flow and/or normal oxygen product purity), the pressure set point of the lower pressure column, feeding of liquid to the closed core, and oxygen product flow can be slowly transition back to the normal values.

A method for starting up an air separation plant having a higher-pressure column, a lower-pressure column, and a falling film vaporizer disposed within a lower section of the lower-pressure column is provided. In certain embodiments, the method can include the steps of: introducing a cooled and compressed air stream into the higher pressure column; withdrawing an oxygen-enriched liquid stream from a bottom section of the higher-pressure column and introducing said oxygen-enriched liquid stream to an upper section of the lower-pressure column; and exchanging heat between nitrogen gas coming from a top section of the higher-pressure column and liquid oxygen from the lower-pressure column within the falling film vaporizer. In certain embodiments, the falling film vaporizer can include an open core and a closed core. In certain embodiments, during a start-up period, flow of liquid oxygen is at least reduced to the closed core.

In optional embodiments of the method for starting up an ASU with a falling film vaporizer:

- the lower-pressure column has a first pressure set point during startup and a second pressure set point during steady state operation, wherein the first pressure set point is at least 1 psig higher than the second pressure set point;
- the air separation plant further comprises a liquid oxygen pump and distribution means that are configured to transfer liquid oxygen from the lower section of the lower-pressure column to the falling film vaporizer;

the distribution means are further configured to selectively transfer the liquid oxygen to the open core without sending any liquid oxygen to the closed core during the start-up period;

the distribution means are further configured to transfer the liquid oxygen to the closed core during a steady state operation;

the method can also include withdrawing a liquid oxygen product from the lower-pressure column; and/or the flow rate of the liquid oxygen product is reduced during the start-up period as compared to during a steady state operation.

In another embodiment of the invention, the method can include the steps of: introducing a cooled and compressed air stream into the higher pressure column; withdrawing an oxygen-enriched liquid stream from a bottom section of the higher-pressure column and introducing said oxygen-enriched liquid stream to an upper section of the lower-pressure column; exchanging heat between nitrogen gas coming from a top section of the higher-pressure column and liquid oxygen from the lower-pressure column within the falling film vaporizer; withdrawing a liquid oxygen product from the lower-pressure column, wherein the falling film vaporizer comprises an open core and a closed core, wherein during the start-up operation, the method further comprises: flowing liquid oxygen to only the open core of the falling film vaporizer; increasing a pressure set point for the lower-pressure column as compared to steady state operation; and reducing the flow rate of liquid oxygen product from the lower-pressure column as compared to steady state operation.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying FIGURE. It is to be expressly understood, however, that the FIGURE is provided for the purpose of illustration and description only and is not intended as a definition of the limits of the present invention

BRIEF DESCRIPTION OF THE DRAWING(S)

These and other features, aspects, and advantages of the present invention will become better understood with regard to the following description, claims, and accompanying drawing(s). It is to be noted, however, that the drawing(s) illustrate only several embodiments of the invention and are therefore not to be considered limiting of the invention's scope as it can admit to other equally effective embodiments.

The FIGURE provides an embodiment of the present invention.

DETAILED DESCRIPTION

While the invention will be described in connection with several embodiments, it will be understood that it is not intended to limit the invention to those embodiments. On the contrary, it is intended to cover all the alternatives, modifications and equivalence as may be included within the spirit and scope of the invention defined by the appended claims.

Now turning to the FIGURE. Air 2, which has previously been compressed, purified, and cooled in a main heat exchanger is introduced into at least the higher pressure column 10. Oxygen enriched stream 12 is withdrawn from a lower portion of higher pressure column 10 and sent to an intermediate section of lower pressure column 20 for further separation. A liquid nitrogen stream 14, which is formed by nitrogen enriched vapors condensing in falling film vaporizer 30, is withdrawn from an upper portion of higher pressure column 10 and sent to an upper portion of lower pressure column 20 to act as a reflux stream.

Within lower pressure column 20, a liquid phase will begin to fall and collect in the sump of the lower pressure column. During the start-up phase, LOX 22 is withdrawn from the lower pressure column 20 and returned to the open core 33 using pump 50 and opening valve 40 while valve 42 is closed. In a preferred embodiment, purification unit 55 can be included to remove unwanted impurities, such as hydrocarbons that tend to accumulate in the sump region of the lower-pressure column.

By only sending LOX to the open core 33 during this start-up period, the heat transfer area is reduced, which allows it to cool faster, and increases the temperature differential across the falling film vaporizer 30, and consequently, the differential pressure between the high pressure column and low pressure column. It has the advantage of overcoming the hydraulic problem often associated with insufficient differential pressure between the high and low distillation columns for liquid transfer during this transient mode of operation.

Once the start-up phase has completed, which can be indicated by establishment of normal air flow and/or proper oxygen product purity, valve 42 can be opened, thereby allowing flow of LOX to closed core 35.

In another embodiment, during the start-up phase, the pressure set point for the lower pressure column is higher than its steady state set point (e.g., 8 psig instead of 5.5 psig). Further, for every 1 psig increase of the pressure set point for the lower pressure column, the resulting operating pressure of the higher pressure column is greater than 1 psig. This is advantageous during start-up because it can ensure an adequate pressure differential between the two columns, and therefore any hydraulic issues related to improper flows of streams 12 or 14 are mitigated or eliminated, which in turn helps to prevent potential plant trips caused by lack of flow during this transient mode of operation.

In certain embodiments, the pressure set point can be controlled by using a pressure controller to control the lower pressure column pressure by regulating an outgoing vapor stream from the lower pressure column (e.g., waste nitrogen or another low pressure nitrogen stream not shown in the FIGURE).

Certain embodiments of the invention provide the advantage of more consistency during startup due to lower reliance on operator experience. Based on experiments, startup times using certain embodiments of the invention have improved anywhere between a few hours and a full operating day. In addition to reduced time costs, depending on the size of the ASU, the power savings can be tens of thousands dollars in electricity alone.

The terms "nitrogen-rich" and "oxygen-rich" will be understood by those skilled in the art to be in reference to the composition of air. As such, nitrogen-rich encompasses a fluid having a nitrogen content greater than that of air. Similarly, oxygen-rich encompasses a fluid having an oxygen content greater than that of air.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

I claim:

1. A method for starting up an air separation plant having a higher-pressure column, a lower-pressure column, and a falling film vaporizer disposed within a lower section of the lower-pressure column, the method comprising the steps of:

introducing a cooled and compressed air stream into the higher pressure column;

withdrawing an oxygen-enriched liquid stream from a bottom section of the higher-pressure column and introducing said oxygen-enriched liquid stream to an upper section of the lower-pressure column; and exchanging heat between nitrogen gas coming from a top section of the higher-pressure column and liquid oxygen from the lower-pressure column within the falling film vaporizer, wherein the falling film vaporizer comprises an open core and a closed core, wherein during a start-up period, flow of liquid oxygen is at least reduced to the closed core as compared to during a steady state operation.

2. The method as claimed in claim 1, wherein the lower-pressure column has a first pressure set point during startup and a second pressure set point during steady state operation, wherein the first pressure set point is at least 1 psig higher than the second pressure set point.

3. The method as claimed in claim 1, wherein the air separation plant further comprises a liquid oxygen pump and distribution means that are configured to transfer liquid oxygen from the lower section of the lower-pressure column to the falling film vaporizer.

4. The method as claimed in claim 3, wherein the distribution means are further configured to selectively transfer the liquid oxygen to the open core without sending any liquid oxygen to the closed core during the start-up period.

5. The method as claimed in claim 4, wherein the distribution means are further configured to transfer the liquid oxygen to the closed core during a steady state operation.

6. The method as claimed in claim 1, further comprising withdrawing a liquid oxygen product from the lower-pressure column.

7. A method for operating an air separation plant having a higher-pressure column, a lower-pressure column, and a falling film vaporizer disposed within a lower section of the lower-pressure column, the air separation plant having a start-up operation and a steady state operation, the method comprising the steps of:

introducing a cooled and compressed air stream into the higher pressure column;

withdrawing an oxygen-enriched liquid stream from a bottom section of the higher-pressure column and introducing said oxygen-enriched liquid stream to an upper section of the lower-pressure column;

exchanging heat between nitrogen gas coming from a top section of the higher-pressure column and liquid oxygen from the lower-pressure column within the falling film vaporizer;

withdrawing a liquid oxygen product from the lower-pressure column, wherein the falling film vaporizer comprises an open core and a closed core, wherein during the start-up operation, the method further comprises:

flowing liquid oxygen to only the open core of the falling film vaporizer;

increasing a pressure set point for the lower-pressure column as compared to steady state operation; and reducing the flow rate of liquid oxygen product from the lower-pressure column as compared to steady state operation.

* * * * *